US010833452B2

(12) United States Patent
Loas

(10) Patent No.: US 10,833,452 B2
(45) Date of Patent: Nov. 10, 2020

(54) CONNECTOR WITH A LEVER FOR ASSISTANCE WITH CONNECTION AND METHOD FOR PACKAGING A CONNECTOR OF THIS TYPE

(71) Applicant: Aptiv Technologies Limited, St. Michael (BB)

(72) Inventor: Sylvain Loas, Louveciennes (FR)

(73) Assignee: APTIV TECHNOLOGIES LIMITED (BB)

( * ) Notice: Subject to any disclaimer, the term of this patent is extended or adjusted under 35 U.S.C. 154(b) by 0 days.

(21) Appl. No.: 16/517,922

(22) Filed: Jul. 22, 2019

(65) Prior Publication Data

US 2020/0036134 A1 Jan. 30, 2020

(30) Foreign Application Priority Data

Jul. 27, 2018 (FR) ..... 18 57005

(51) Int. Cl.

| | |
|---|---|
| ***H01R 13/62*** | (2006.01) |
| ***H01R 13/629*** | (2006.01) |
| ***H01R 13/642*** | (2006.01) |
| ***H01R 13/639*** | (2006.01) |

(52) U.S. Cl.

CPC . *H01R 13/62955* (2013.01); *H01R 13/62938* (2013.01); *H01R 13/639* (2013.01); *H01R 13/642* (2013.01)

(58) Field of Classification Search

CPC ..... H01R 13/62955

See application file for complete search history.

(56) References Cited

U.S. PATENT DOCUMENTS

| | | | | |
|---|---|---|---|---|
| 8,784,127 | B2 | 7/2014 | Bashkin et al. | |
| 9,407,037 | B2 * | 8/2016 | Kim | H01R 13/62938 |
| 2015/0295352 | A1 | 10/2015 | Kim et al. | |

FOREIGN PATENT DOCUMENTS

| | | | |
|---|---|---|---|
| DE | 202013000998 | U1 | 2/2014 |
| EP | 2675021 | A2 | 12/2013 |
| EP | 2863490 | A1 | 4/2015 |
| JP | 2010146950 | A | 7/2010 |
| KR | 20090073844 | A | 7/2009 |
| WO | 2015/119788 | A1 | 8/2015 |

* cited by examiner

*Primary Examiner* — Ross N Gushi

(74) *Attorney, Agent, or Firm* — Billion & Armitage; Robert Myers

(57) ABSTRACT

The invention relates to a connector with a lever for assistance with the connection. Means for locking the lever are fitted such as to slide on the lever, between three positions, i.e. a locking position in which the means for locking the lever block the lever in its closed position, an unlocking position in which the means for locking the lever free the lever in order to allow the lever to rotate to its open position, and a delivery position, which is distinct from the locking and unlocking positions, in which the lever can be in a closed position without being blocked by the locking means. In the delivery position, the locking means are not constrained.

19 Claims, 3 Drawing Sheets

CONNECTOR WITH A LEVER FOR ASSISTANCE WITH CONNECTION AND METHOD FOR PACKAGING A CONNECTOR OF THIS TYPE

CROSS-REFERENCE TO RELATED APPLICATION

This application claims the benefit under 35 U.S.C. § 119(a) of French Application FR1857005, filed Jul. 27, 2018, the entire disclosure of which is hereby incorporated herein by reference.

TECHNICAL FIELD OF DISCLOSURE

The invention relates to the field of connections, and in particular that of motor vehicle connections.

BACKGROUND OF DISCLOSURE

Connectors are used in order to transmit signals or electrical energy between cables, devices (computer, lighting, etc.) or motors. In particular, electrical connectors comprise electrical contacts of a greater or lesser number, or of a greater or lesser size.

In addition, in order to prevent the operators responsible for carrying out the assembly and connection of the connectors to one another from having muscular-skeletal problems, in order to ensure easy and reliable connection, and in order to prevent the risks of faulty connections, the connectors, and in particular connectors for the motor vehicle industry, can be equipped with a lever to assist the mating.

Thus, connectors are known with a lever fitted such as to rotate on a casing, the lever comprising two lever arms which are articulated around an axis of rotation, each respectively on a face of the casing, perpendicular to the axis of rotation. Each of these arms is provided with teeth which cooperate with racks of a counter-connector. The lever is thus mobile between two positions, i.e. an open position, corresponding to a position of pre-mating or start of mating of the connector with a counter-connector, and a closed position, corresponding to a position in which the connector is completely mated with the counter-connector. In other words, the lever is placed in an open position when the connector is placed facing a counter-connector, in order to mate the connector with the counter-connector. Then, the lever is tilted from this open position to its closed position. During this manoeuvre, the teeth of the lever engage with the racks of the counter-connector, in order to mate and connect the connector with the counter-connector. When the lever is in the closed position, the connector and counter-connector are completely mated and connected.

This type of connector can be provided with locking means which block the lever in its closed position, in order to prevent the lever from tilting, accidentally or under the effect of vibrations, to its open position, and to prevent the connector and counter-connector from becoming disconnected.

Connectors of this type are described for example in document EP2675021A2 or in document EP2863490A1.

SUMMARY OF THE DISCLOSURE

For reasons of dimensions and/or in order to limit the risk of breaking the lever, it is preferable, during periods of storage and delivery, for the lever to be in the closed position, without it being locked however.

Thus, according to the invention, a connector is provided comprising:

- a casing;
- a lever for assistance with connection which is articulated on the casing, around an axis of rotation, between at least an open position, in which a counter-connector can be mated with the connector in a direction of mating substantially perpendicular to the axis of rotation of the lever, and a closed position, in which the connector and the counter-connector are mated together;
- means for locking the lever which are mobile between a locking position, in which the means for locking the lever block the lever in its closed position, and an unlocking position, in which the means for locking the lever release the lever in order to permit rotation of the lever around the axis of rotation, to its open position.

In addition, the locking means are configured to be able to occupy a delivery position, distinct from the locking and unlocking positions, in which the lever can be in the closed position, without being blocked by the locking means, and in which the locking mean are not under constraint.

Thanks to the invention, apart from the fact that the connector can be packaged with limitation of the volume which it occupies, whilst reducing or preventing breakage of the lever, the connector can be stored for long periods of time without the efficiency of the means for locking the lever deteriorating over a period of time.

In fact, the locking means with which the connectors are provided are often in the form of a lock produced by moulding a plastic material. It is therefore necessary to prevent elements of the locking means from being maintained under stress for long periods. Under the effect of the temperature and/or time, the plastic material can creep and/or be deformed, which can give rise to malfunctioning and/or loss of reliability of the locking means.

Thus, advantageously, the locking means do not remain under constraint for prolonged periods. In fact, there are two particular periods during which a connector can remain without movement of the lever and the locking means. These are firstly the periods of storage and delivery before the connector is used, and secondly the period of use when the connector is connected in an operational manner with a counter-connector.

Thus, the connector according to the invention can comprise locking means which comprise at least one flexible branch which cooperates with the casing in order to block the lever in the closed position, this flexible branch not being under constraint (i.e. not under permanent constraint) when the locking means are in the delivery position or in the locking position.

In addition, the connector according to the invention can optionally comprise one or another of the following characteristics, considered in isolation or in combination with one or a plurality of others:

- in their delivery position, the locking means cannot be displaced, without manipulating the lever, to their locking position;
- the locking means comprise at least one resiliently flexible branch which cooperates with the casing in order to block the lever in the closed position, this branch not being under constraint when the locking means are in the delivery position or in the locking position; for example, the branch cooperates with the casing by engagement of a tooth in a notch (each being provided respectively on the branch or on the casing), without the branch being deflected when the locking means are in the delivery position or in the locking position;

the locking means are fitted such as to slide on the lever between, successively, the positions of delivery, unlocking and locking, and vice versa; for example, for this purpose, the locking means are fitted such as to slide on the lever in a direction which is contained substantially on a plane perpendicular to the axis of rotation of the lever;

the locking means are blocked by a stop on the lever in order to prevent displacement from their unlocking position to their locking position, when the lever is in the open position; and the locking means cooperate with the casing when they are in the locking position and the lever is tilted into the closed position, in order to escape from the stop and permit their displacement from their unlocking position to their locking position;

the locking means are constituted by a lock which is configured to be displaced between the positions of delivery, unlocking and locking, and vice versa, this lock comprising at least one unlocking tooth which extends from a flexible branch towards the exterior of the connector, parallel to the axis of rotation of the lever, and formed such as to cooperate with the casing when the lock is in the unlocking position and the lever is tilted from its open position to its closed position, and thus to deflect the branch comprising this unlocking tooth, in order for the lock to escape from the stop, and to be able to be displaced from its unlocking position to its locking position;

the locking means are constituted by a lock which is configured to be displaced between the positions of delivery, unlocking and locking, and vice versa, this lock comprising at least one locking tooth which extends from a branch towards the exterior of the connector, parallel to the axis of rotation of the lever, and formed such as to cooperate with the lever and prevent the displacement of the lock from its unlocking position to its locking position;

the casing comprises a resilient locking tongue which is configured to block the lever in the closed position, and the locking means are constituted by a lock which is configured to be displaced between the positions of delivery, unlocking and locking, and vice versa, this lock comprising at least one hook which is configured:

i. to cooperate with the tongue when the lock is in the locking position, and thus prevent the lever from being released from the resilient tongue; and ii. not to interfere with the tongue when the lock is in the delivery position, in order to make it possible to free the lever from the tongue by making the tongue bend.

According to another aspect, the invention relates to a method for packaging a connector, wherein the connector comprises:

a casing;

a lever for assistance with connection which is articulated on the casing, around an axis of rotation, between at least an open position, corresponding to a position of mating of the connector with a counter-connector, and a closed position, corresponding to a position in which the connector is mated with a counter-connector;

means for locking the lever which slide between a locking position, in which the means for locking the lever block the lever in its closed position, and an unlocking position, in which the means for locking the lever free the lever in order to permit rotation of the lever around the axis of rotation, to its open position.

In this method, the connector is packaged, for example in a box, by placing the lever in the closed position, and placing the locking means in a delivery position, distinct from the locking and unlocking positions, in which the locking means are not under constraint.

BRIEF DESCRIPTION OF DRAWINGS

Other characteristics and advantages of the invention will become apparent from reading the following detailed description, and from the appended drawings. In these drawings.

In the different figures, elements which are similar or identical bear the same references.

DETAILED DESCRIPTION

Figure 1:
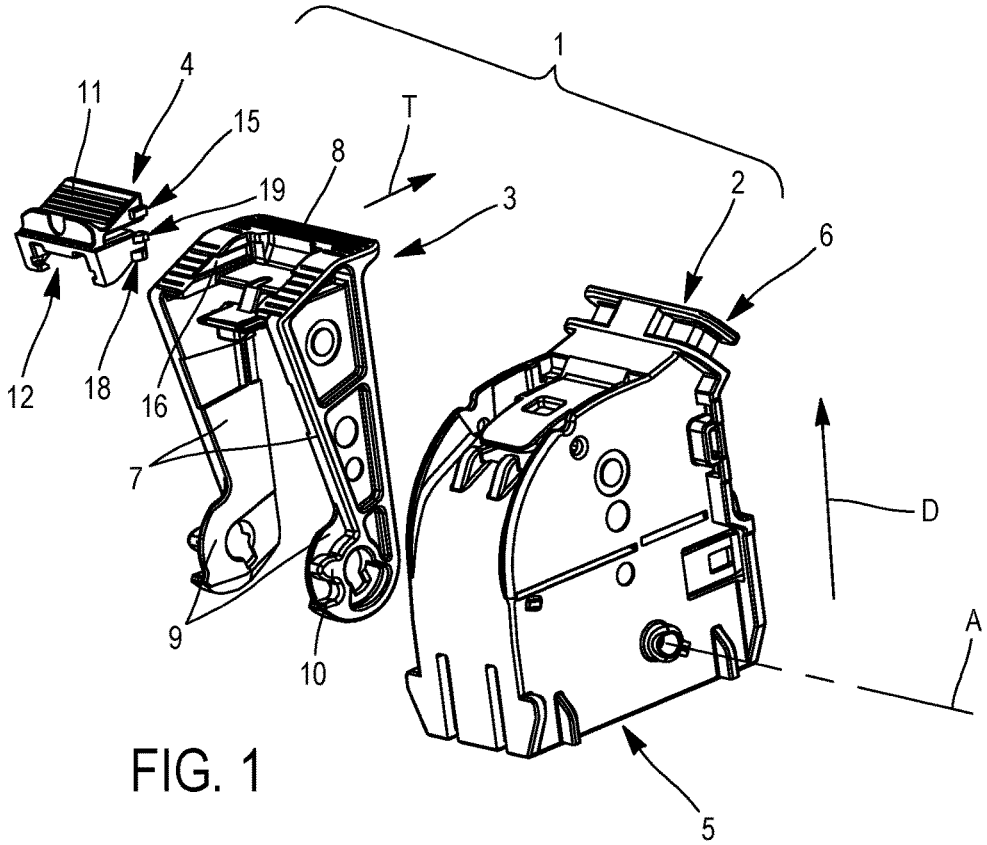
FIG. 1 represents schematically in perspective and in an exploded manner an embodiment of a connector according to the invention.

An example of embodiment of a connector according to the invention represented in FIG. 1. The connector 1 comprises a casing 2 and locking means 4. These elements are made of moulded resin with dielectric properties.

Figure 2:
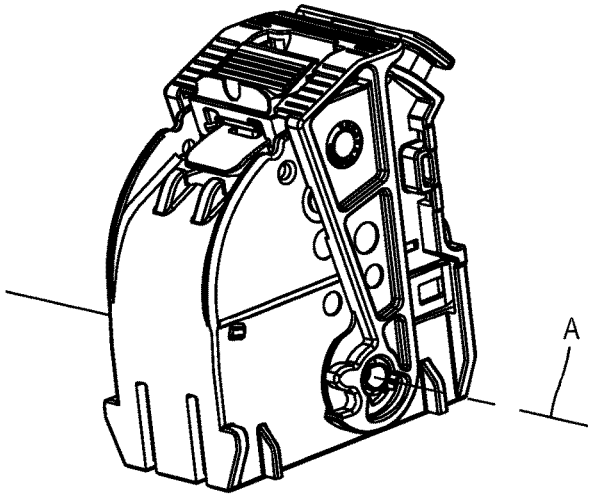
FIG. 2 represents schematically in perspective the connector in FIG. 1, with the lever in the closed position.

The casing 2 has a face 5 for mating with a counter-connector (not represented) and a wire-guide passage 6. The mating face 5 is provided with contacts (not represented) connected electrically to wires or cables (not represented) which exit from the connector 1 via the wire-guide passage 6. These contacts are designed to be connected with contacts of the counter-connector (not represented) by bringing the connector 1 and the counter-connector towards one another, fitting them into one another in a direction of mating D, then mating them to one another by performing rotation of the lever 3 around an axis of rotation A, from an open position of the lever (FIG. 3) to a closed position of the lever (FIG. 2). The open position corresponds to a position in which the connector 1 is positioned in order to be mated with a counter-connector. The closed position corresponds to a position in which the connector 1 is completely mated with the counter-connector, and in which the contacts of the connector and the counter-connector are electrically connected to one another.

The axis of rotation A of the lever 3 is parallel to the mating face 5, and perpendicular to the direction of mating D with the counter-connector. The lever 3 comprises two arms 7. The arms 7 are connected by one of their ends to a handle 8. Their other end is provided with a flange 9 which is fitted such as to rotate on the casing 2 around the axis of rotation A. Each flange 9 is provided with teeth 10 configured to cooperate with a respective rack which is present on the counter-connector, in order to mate the connector 1 with the counter-connector when the lever 3 is tilted from its open position (FIG. 3) to its closed position (FIG. 2).

In the embodiment described here, the locking means 4 are in the form of a lock which is fitted such as to slide on the lever 3 in a direction of translation T, parallel to a plane perpendicular to the axis of rotation A. More particularly, the lock is fitted such as to be mobile in translation on the handle 8, between, successively, along the direction T, a delivery position, an unlocking position and a locking position.

Figure 10:
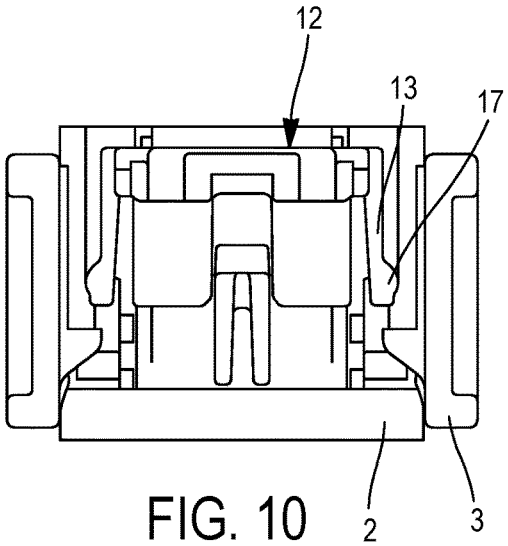
FIGS. 10 and 11 represent schematically seen from above and in cross-section, respectively on two different planes, a part of the connector in FIGS. 1 to 3, with the lever in the closed position and with the means for locking the lever in the delivery position.

The lock comprises an actuation surface 11 below which there is a slide 12. This slide 12 comprises two branches 13 extending longitudinally between an end connected to a base 14 (see FIGS. 10, 12 and 15), and a free end. The branches 13 are flexible, and can be deformed resiliently and bent towards the base 14. The base 14 comprises two ribs 15, which each extend laterally towards the exterior of the connector (see FIGS. 1, 4, 6 and 7). These ribs 15 extend longitudinally in the direction T. They penetrate and slide, in the direction T, in slides 16 provided in the handle 8 of the lever 3.

Figure 15:
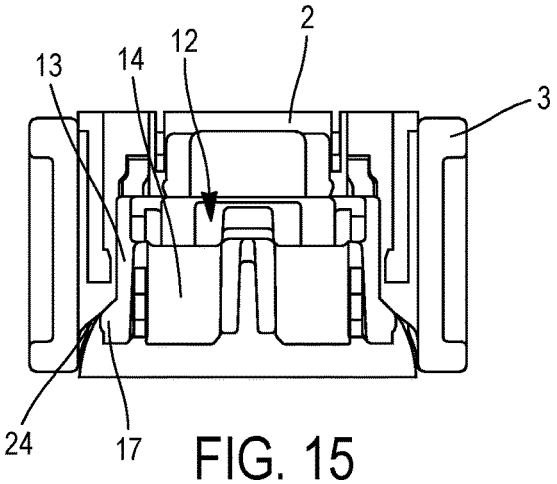

Each branch 13 comprises a locking tooth 17 and an unlocking tooth 18. These locking 17 and unlocking 18 teeth extend from each of the branches 13, towards the exterior of the connector 1, parallel to the axis of rotation A of the lever 3 (see FIGS. 1, 6 and 7). Each locking tooth 17 is formed such as to cooperate with the lever 3, and prevent the free displacement of the lock 4 from its unlocking position to its locking position (FIG. 12) and vice versa (FIG. 15). Each unlocking tooth 18 is formed such as to cooperate with the casing 2, when the lock 4 is in the unlocking position, and the lever 3 is tilted from its open position to its closed position (FIG. 13), and thus deflect the branches 13 each comprising respectively unlocking teeth 18, in order for the lock 4 to escape from the stop 26, and to be able to be displaced from its unlocking position to its locking position.

The connector 1 is packaged for its storage and transport, for example in a box, loose or in a storage cell provided for this purpose. According to the invention, it is packaged, as represented in FIG. 2, by placing the lever 3 in the closed position and the locking means 4 in the delivery position.

Figure 4:
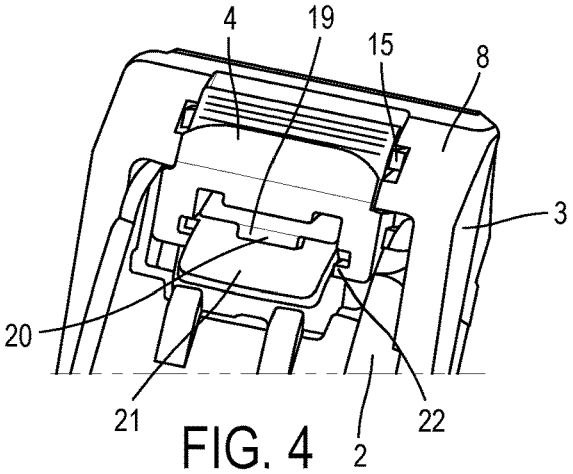
FIGS. 4 and 5 represent schematically in perspective a part of the connector in FIGS. 1 to 3, with the lever in the closed position, with the means for locking the lever respectively in the delivery position and in the locking position.

As represented in FIG. 4, when the lever 4 is in the closed position, it is blocked in this position thanks to primary locking means. According to the embodiment described here, these primary locking means comprise a lug 19 and an opening 20 provided in a locking tongue 21, which is resilient and integral with the casing 2. In the closed position of the lever 3 (FIGS. 4 and 5), the lug 19 is engaged in the opening 20. However, in the delivery position, the lock 4 does not interact with the resilient tongue 21. It is then sufficient to press on the free end of the tongue 21 to release the lug 19 from the opening 20 and free the lever 3.

Figure 5:
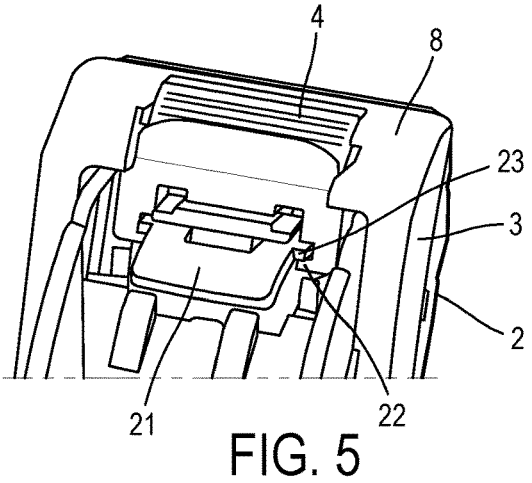

On the other hand, as represented in FIG. 5, when the lever 3 is in the closed position, and it is wished to lock it in this position so that it does not tilt accidentally, for example because pressure has involuntarily been exerted on the tongue 21, the lock 4 must be put in the locked position. The lock 4 thus forms secondary locking means.

More particularly, the lock 4 comprises two hooks 22 which are situated opposite one another, each respectively at a longitudinal edge of the tongue 21. Each hook 22 has the form of a "U" (when it is seen in transverse cross-section). Each hook 22 thus forms a channel or slide in which there can be engaged a rib 23 which extends the tongue 21 laterally towards the exterior.

In the delivery position of the lock 4, the ribs 23 do not penetrate in the hooks 22. There is no interference between the tongue 21 and the lock 4. The flexibility of the tongue 21 can thus be used to release the lug 19 from the opening 20 (FIG. 4). The lever 3 can be freed from the tongue 21 by making the tongue bend.

In the locking position of the lock 4, the ribs 23 are engaged in the hooks 22, thus preventing the tongue 23 from being able to bend under the effect of a pressure exerted on its free end (FIG. 5). This prevents the lever 3 from being released from the tongue 21, and being able to be tilted to its open position. This therefore prevents uncoupling and accidental disconnection of the connector 1 and the counter-connector.

As represented in FIGS. 6, 8, 10 and 11, when the lock is in the delivery position, the branches 13 are not constrained. The locking 17 and unlocking 18 teeth do not interfere either with the casing 2, or with the lever 3. They are accommodated freely in notches or recesses 24 provided in the inner face of the walls of the casing 2.

Likewise, as represented in FIGS. 7, 9, 14 and 15, when the lock 4 is in the locking position, the branches 13 are not constrained. The locking 17 and unlocking 18 teeth do not interfere either with the casing 2, or with the lever 3. In particular they are accommodated freely in notches or recesses 24 provided in the inner face of the walls of the casing 2.

Figure 13:
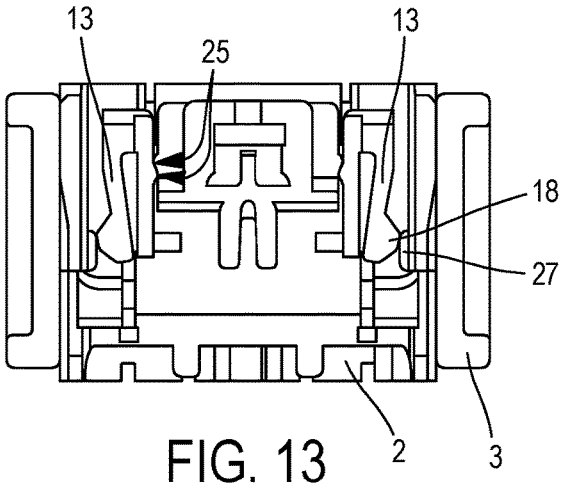
Figure 14:
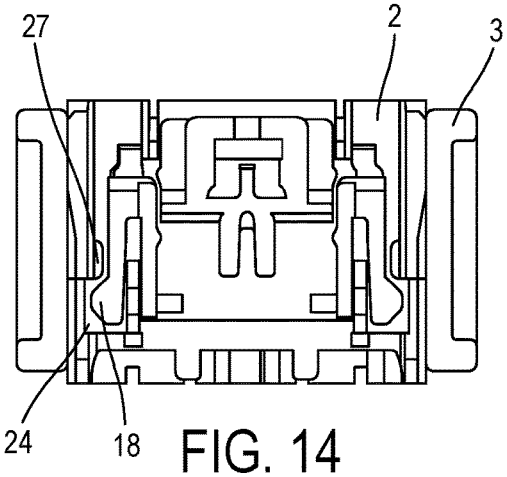
FIGS. 14 and 15 represent schematically seen from above and in cross-section, respectively on two different planes, a part of the connector in FIGS. 1 to 3, with the lever in the closed position with the means for locking the lever in the locking position.

On the other hand, as represented in FIG. 13, when the lock 4 is in the unlocking position, the branches 13 are constrained. The unlocking teeth 18 interfere with the casing 2, in order to make the branches 13 bend.

The operative mode for use of the locking means 4 is described below.

Figure 3:
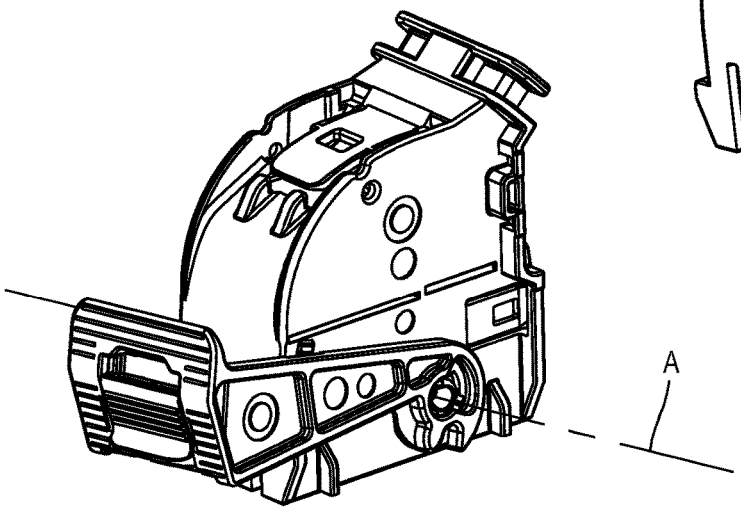
FIG. 3 represents schematically in perspective the connector in FIG. 1, with the lever in the open position.

When the connector 1 must be used to be connected to a counter-connector, an operator exerts pressure on the free end of the tongue 21. He thus frees the lug 19 from the opening 20. Since the lock 4 is in the delivery position, the hooks 22 do not interfere with the tongue 21. The operator can then tilt the lever 3 from its closed position (FIG. 2) to its open position (FIG. 3).

Figure 11:
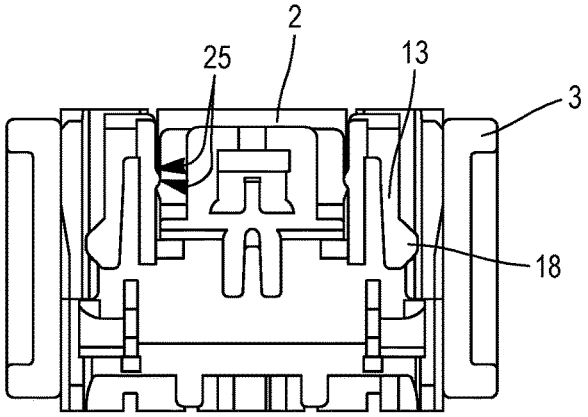
Figure 12:
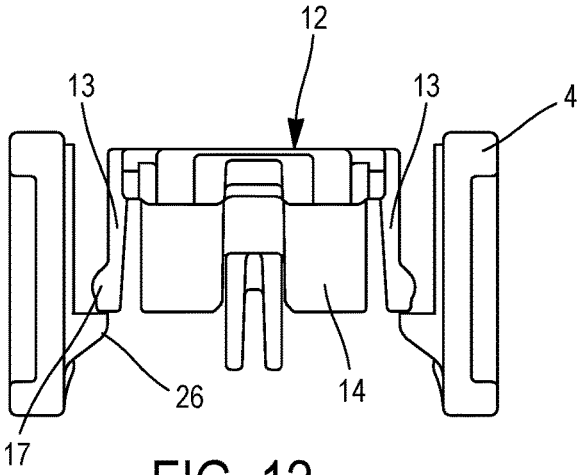
FIGS. 12 and 13 represent schematically in cross-section a part of the connector in FIGS. 1 to 3, respectively with the lever in the open position and in the closed position, and with the means for locking the lever in the unlocking position.

Once the lever 3 is in the open position, the lock 4 is displaced, in the direction T, from its delivery position to its unlocking position. During this maneuver, protuberances 25 placed on the lock 4 and on the lever 3 interfere, in order to provide slight resistance which the operator can easily overcome (FIG. 11). This gives the operator the sensation of passing over a catch. After passing over this catch, the lock 4 is blocked by the locking teeth 17 which abut stops 26 which are integral with the lever 3, and prevent the displacement of the lock 4 further forwards, to its locking position (FIG. 12). In addition, the protuberances 25 also interfere in order to retain the lock in this unlocked position (FIG. 13).

The respective mating faces 12 of the connector 1 and the counter-connector are presented such as to face one another. The connector 1 and the counter-connector begin to be fitted in one another until the teeth 10 of the lever 3 can cooperate with the racks of the counter-connector.

The operator can then tilt the lever 3 from its open position to its closed position, in order to mate the connector 1 completely with the counter-connector.

Figure 6:
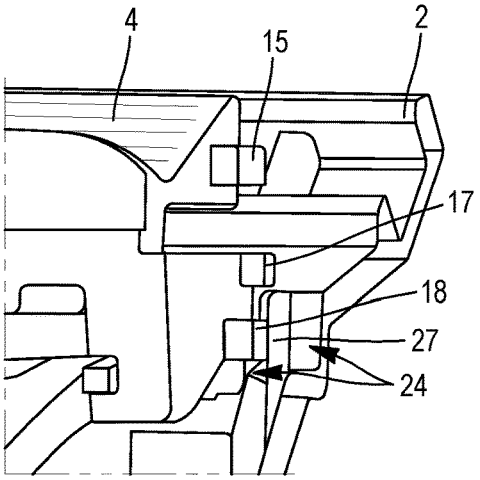
FIGS. 6 and 7 represent schematically in perspective and in cross-section a part of the connector in FIGS. 1 to 3 with the lever in the closed position and with the means for locking the lever respectively in the delivery position and in the locking position, the lever having been concealed in order to see better the interaction of the locking means with the casing of the connector.
Figure 7:
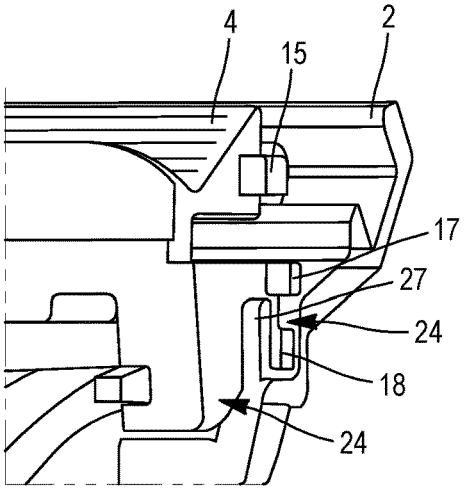
Figure 8:
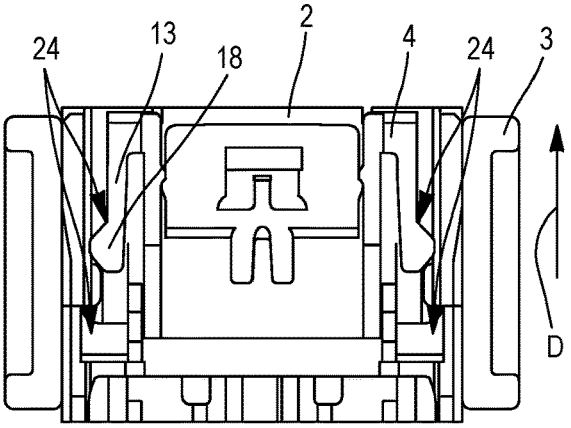
FIGS. 8 and 9 represent schematically in cross-section and seen from above a part of the connector in FIGS. 1 to 3, with the lever in the closed position with the means for locking the lever respectively in the delivery position and in the locking position.
Figure 9:
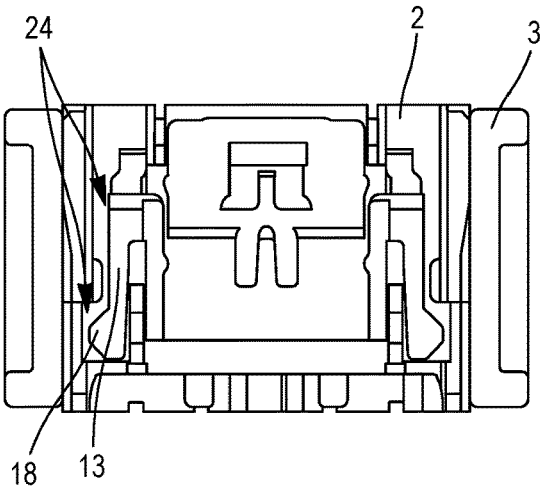

When the lever 3 is in the closed position, as the lock 4 is in the unlocked position (FIG. 13), the unlocking teeth 18 each interfere respectively with a rib 27 provided on the inner face of the wall of the casing, which makes the resilient branches bend (see also the rib 27 in FIGS. 6 and 7). The free ends of the branches 13 then approach the base 14. The bending of the branches 13 makes it possible to release the locking teeth 17, which had been blocked (as in FIG. 12), each respectively by the stops 26 formed on the inner face of the arms 7 of the lever 3.

The lock 4 can then be displaced to its locking position (FIGS. 7, 9, 14 and 15). The beveled forms of the unlocking teeth 18 facilitate this displacement.

When the lock 4 is in the locking position, the locking 17 and unlocking 18 teeth are once again accommodated in notches or recesses 24 provided in the inner face of the walls of the casing 2. The branches 13 are no longer constrained. The constraint which is exerted on the branches 13 is limited to the duration of the passage into the unlocking position of the lock 4. This unlocking position corresponds to an intermediate position, in which the lock is not designed to remain for long (and in all cases not long enough for the plastic material to creep, and for the branches 3 to be deformed relative to the position of rest in which they are when the lock is in the delivery position or in the locking position).

In order to uncouple the connector 1 and the counter-connector, the operator displaces the lock 4 from its locking position (FIGS. 14 and 15) to its unlocking position (FIG. 13). The beveled forms of the locking teeth 17 facilitate this displacement (see FIG. 15). The branches 13 bend when they pass over the stops 26 of the lever 3. Then, continuing the displacement of the lock 4 to its unlocking position, the unlocking teeth 18 are placed on the ribs 27. When the lock is displaced again to its delivery position, the initial position is regained, which makes it possible to free the lug 19 from the opening 20, by pressing on the free end of the tongue 21. Thus, the lever 3 can be tilted to its open position by uncoupling the connector 1 and the counter-connector.

While this invention has been described in terms of the preferred embodiments thereof, it is not intended to be so limited, but rather only to the extent set forth in the claims that follow.

I claim:

1. A connector, comprising:

a casing;

a lever for assistance with connection which is articulated on the casing, around an axis of rotation, between at least an open position, in which a counter-connector can be mated with the connector in a direction of mating substantially perpendicular to the axis of rotation of the lever, and a closed position, in which the connector and the counter-connector are mated together;

a means for locking the lever which are mobile between a locking position, in which the means for locking the lever block the lever in the closed position, and an unlocking position, in which the means for locking the lever release the lever in order to permit rotation of the lever around the axis of rotation, to its open position; wherein the locking means are configured to be able to occupy a delivery position, distinct from the locking and unlocking positions, in which the lever can be in the closed position, without being blocked by the locking means, and in which the locking means are not under constraint, wherein the locking means:

can be displaced from their delivery position to their unlocking position when the lever in the open position:

cannot be displaced from their unlocking position to their locking position when the lever is in the open position; and can be displaced from their unlocking position to their locking position after rotation of the lever from its open position to its closed position.

2. The connector according to claim 1, wherein the locking means comprise at least one resiliently flexible branch which cooperates with the casing in order to block the lever in the closed position, this resiliently flexible branch not being under constraint when the locking means are in a delivery position or in the locking position.

3. The connector according to claim 2, wherein the resiliently flexible branch cooperates with the casing by engagement of a tooth in a notch, the tooth and the notch each being provided respectively on the resiliently flexible branch or on the casing, without the resiliently flexible branch being deflected when the locking means are in the delivery position or in the locking position.

4. The connector according to claim 1, wherein the locking means are fitted such as to slide on the lever between, successively, the positions of delivery, unlocking and locking, and vice versa.

5. The connector according to claim 4, wherein the locking means are fitted such as to slide on the lever in the direction of mating which is contained substantially on a plane perpendicular to the axis of rotation of the lever.

6. The connector according to claim 1, wherein the locking means are blocked by a stop on the lever in order to prevent displacement from their unlocking position to their locking position, when the lever is in the open position, and the locking means cooperate with the casing when they are in the unlocking position and the lever is tilted into the closed position, in order to escape from the stop and permit their displacement from their unlocking position to their locking position.

7. The connector according to claim 6, wherein the locking means are constituted by a lock which is configured to be displaced between the positions of delivery, unlocking and locking, and vice versa, this lock comprising at least one unlocking tooth which extends from a resiliently flexible branch towards the exterior of the connector, parallel to the axis of rotation of the lever, and formed such as to cooperate with the casing when the lock is in the unlocking position and the lever is tilted from its open position to its closed position, and thus to deflect the resiliently flexible branch comprising this unlocking tooth, in order for the lock to escape from the stop, and to be able to be displaced from its unlocking position to its locking position.

8. The connector according to claim 1, wherein the locking means are constituted by a lock which is configured to be displaced between the positions of delivery, unlocking and locking, and vice versa, this lock comprising at least one locking tooth which extends from a resiliently flexible branch towards the exterior of the connector, parallel to the axis of rotation of the lever, and formed such as to cooperate with the lever and prevent the displacement of the lock from its unlocking position to its locking position.

9. Connector according claim 1, wherein the casing comprises a resilient locking tongue which is configured to block the lever in the closed position, and wherein the locking means are constituted by a lock which is configured to be displaced between the positions of delivery, unlocking and locking, and vice versa, this lock comprising at least one hook which is configured:

to cooperate with a tongue when the lock is in the locking position, and thus prevent the lever from being released from the tongue; and not to interfere with the tongue when the lock is in a delivery position, in order to make it possible to free the lever from the tongue by making the tongue bend.

10. A method for packaging a connector, wherein the connector comprises:

a casing;

a lever for assistance with connection which is articulated on the casing, around an axis of rotation, between at least an open position, corresponding to a position of mating of the connector with a counter-connector, and a closed position, corresponding to a position in which the connector is mated with a counter-connector;

a means for locking the lever which slide between a locking position, in which the means for locking the lever block the lever in its closed position, and an unlocking position, in which the means for locking the lever free the lever in order to permit rotation of the lever around the axis of rotation, to its open position; wherein the connector is packaged by placing the lever in a closed position and the locking means in a delivery position which is distinct from the locking and unlocking positions, in which the locking means are not under constraint.

11. A connector, comprising:

a casing;

a lever for assistance with connection which is articulated on the casing, around an axis of rotation, between at least an open position, in which a counter-connector can be mated with the connector in a direction of mating substantially perpendicular to the axis of rotation of the lever, and a closed position, in which the connector and the counter-connector are mated together;

a lever lock which is mobile between a locking position, in which the lever lock blocks the lever in the closed position, and an unlocking position, in which the lever lock releases the lever in order to permit rotation of the lever around the axis of rotation, to its open position; wherein the lever lock is configured to be able to occupy a delivery position, distinct from the locking and unlocking positions, in which the lever can be in the closed position, without being blocked by the lever lock, and in which the lever lock is not under constraint, wherein the lever lock:

can be displaced from its delivery position to its unlocking position when the lever in the open position;

cannot be displaced from its unlocking position to its locking position when the lever is in the open position; and can be displaced from its unlocking position to is locking position after rotation of the lever from its open position to its closed position.

12. The connector according to claim 11, wherein the lever lock comprises at least one resiliently flexible branch which cooperates with the casing in order to block the lever in the closed position, this resiliently flexible branch not being under constraint when the lever lock is in a delivery position or in the locking position.

13. The connector according to claim 12, wherein the resiliently flexible branch cooperates with the casing by engagement of a tooth in a notch, the tooth and the notch each being provided respectively on the resiliently flexible branch or on the casing, without the resiliently flexible branch being deflected when the lever lock is in the delivery position or in the locking position.

14. The connector according to claim 11, wherein the lever lock is fitted such as to slide on the lever between, successively, the positions of delivery, unlocking and locking, and vice versa.

15. The connector according to claim 14, wherein the lever lock is fitted such as to slide on the lever in the direction of mating which is contained substantially on a plane perpendicular to the axis of rotation of the lever.

16. The connector according to claim 11, wherein the lever lock is blocked by a stop on the lever in order to prevent displacement from its unlocking position to is locking position, when the lever is in the open position, and the lever lock cooperates with the casing when it is in the unlocking position and the lever is tilted into the closed position, in order to escape from the stop and permit their displacement from its unlocking position to its locking position.

17. The connector according to claim 16, wherein the lever lock includes a lock which is configured to be displaced between the positions of delivery, unlocking and locking, and vice versa, this lock comprising at least one unlocking tooth which extends from a resiliently flexible branch towards the exterior of the connector, parallel to the axis of rotation of the lever, and formed such as to cooperate with the casing when the lock is in the unlocking position and the lever is tilted from its open position to its closed position, and thus to deflect the resiliently flexible branch comprising this unlocking tooth, in order for the lock to escape from the stop, and to be able to be displaced from its unlocking position to its locking position.

18. The connector according to claim 11, wherein the lever lock includes a lock which is configured to be displaced between the positions of delivery, unlocking and locking, and vice versa, this lock comprising at least one locking tooth which extends from a resiliently flexible branch towards the exterior of the connector, parallel to the axis of rotation of the lever, and formed such as to cooperate with the lever and prevent the displacement of the lock from its unlocking position to its locking position.

19. Connector according claim 11, wherein the casing comprises a resilient locking tongue which is configured to block the lever in the closed position, and wherein the lever lock includes a lock which is configured to be displaced between the positions of delivery, unlocking and locking, and vice versa, this lock comprising at least one hook which is configured:

to cooperate with a tongue when the lock is in the locking position, and thus prevent the lever from being released from the tongue; and not to interfere with the tongue when the lock is in a delivery position, in order to make it possible to free the lever from the tongue by making the tongue bend.

* * * * *